US009406452B2

(12) United States Patent
Inotsuka

(10) Patent No.: US 9,406,452 B2
(45) Date of Patent: Aug. 2, 2016

(54) MOVABLE CONTACT POINT FOR SWITCH

(71) Applicant: Valeo Japan Co., Ltd., Saitama (JP)

(72) Inventor: Tetsuya Inotsuka, Tokyo (JP)

(73) Assignee: Valeo Japan Co., Ltd. (JP)

( * ) Notice: Subject to any disclaimer, the term of this patent is extended or adjusted under 35 U.S.C. 154(b) by 37 days.

(21) Appl. No.: 14/332,540

(22) Filed: Jul. 16, 2014

(65) Prior Publication Data

US 2015/0027867 A1 Jan. 29, 2015

(30) Foreign Application Priority Data

Jul. 29, 2013 (JP) ..... 2013-157195

(51) Int. Cl.
*H01H 1/36* (2006.01)

(52) U.S. Cl.
CPC ..... *H01H 1/36* (2013.01); *H01H 1/365* (2013.01); *H01H 2205/002* (2013.01); *H01H 2205/016* (2013.01); *H01H 2231/026* (2013.01)

(58) Field of Classification Search
CPC ..... H01H 1/36; H01H 1/365; H01H 1/18; H01H 2205/016; H01H 2205/002; H01H 2231/026
USPC ..... 200/531, 536, 541, 547, 549–550, 571; 439/66
See application file for complete search history.

(56) References Cited

U.S. PATENT DOCUMENTS 5,412,170 A * 5/1995 Hofmann ..... H01H 1/365 200/531
8,052,428 B2 * 11/2011 Tsao ..... H01R 4/4809 439/66
2001/0032777 A1 * 10/2001 Finch ..... H01H 15/005 200/16 C
2004/0048498 A1 * 3/2004 Huang ..... H01R 12/57 439/66

FOREIGN PATENT DOCUMENTS

JP 2012-197022 10/2012

* cited by examiner

*Primary Examiner* — Felix O Figueroa
(74) *Attorney, Agent, or Firm* — Fishman Stewart PLLC

(57) ABSTRACT

A movable contact point for an inhibiter switch includes a movable contact point that makes pressure contact with a fixed contact point is slid to cause the movable contact point and the fixed contact point to be connected and disconnected. The movable contact point comprises parallel side wall portions and a sliding portion that slides on the fixed contact point and that connects end portions of the side wall portions. Projecting portions that project in the sliding direction are provided in notch portions in the side walls, wherein the projecting portions abut against each other between the side wall portions in the sliding direction.

8 Claims, 5 Drawing Sheets

MOVABLE CONTACT POINT FOR SWITCH

CROSS-REFERENCE TO RELATED APPLICATION

This application claims priority under 35 USC 119 from Japanese Patent Application No. 157195/2013 filed on Jul. 29, 2013, the disclosure of which is incorporated by reference herein.

BACKGROUND OF THE INVENTION

1. Field of the Invention

The present invention relates to a movable contact point for a switch.

2. Description of the Related Art

For example, Japanese Patent Laid-Open Publication No. 2012-197022 proposes various kinds of switches configured such that movable contact points making pressure contact with fixed contact points are moved in the circumferential direction around a rotary shaft, thus connecting/disconnecting the fixed contact point and the movable contact point.

FIG. 4 is an exploded perspective view explaining the configuration of an inhibiter switch 10 according to the conventional example that is represented by the inhibiter switch disclosed in Japanese Patent Laid-Open Publication No. 2012-197022. It should be noted that FIG. 4 is a cross section showing the periphery of a shaft portion 51 in a movable board 5.

FIGS. 5A to 5C are diagrams explaining a movable contact point 7X according to the conventional example.

A body case 4 of the inhibiter switch 10 is formed by coupling a cover 3 to a peripheral wall 24 that surrounds an area of a pole board 2 where fixed contact points 8 are disposed, and the movable board 5 provided with the movable contact points 7X is provided inside the body case 4 to be rotatable around an axis line X.

The movable board 5 includes a cylindrical shaft portion 51 and a contact point holding portion 52 extending in a radial direction (radial direction of the axis line X) from the shaft portion 51, and each of the movable contact points 7X is accommodated in an accommodation hole 53 formed in the contact point holding portion 52 together with a spring Sp.

Each of the movable contact points 7X projects downward to the pole board 2-side from the accommodation hole 53 by an urging force acting from the spring Sp, and is configured to make pressure contact with the fixed contact point 8 exposed on an upper surface of the pole board 2 in a state where the movable board 5 is incorporated in the body case 4.

A shaft rotating in association with an operation of a shift lever is coupled to the shaft portion 51 of the movable board 5. When the shift lever is operated, the contact point holding portion 52 extending in the radial direction from the shaft portion 51 rotates around the axis line X in association with the operation of the shift lever. Thereby, the movable contact point 7X having made pressure contact with the fixed contact point 8 moves (slides) in a circumferential direction around the axis line X.

The movable contact point 7X has a basic configuration formed by bending one sheet of metallic plate in a U-letter shape, and as shown in FIG. 5A, a sliding portion 72 that slides on the fixed contact point 8 is positioned between side wall portions 71 disposed in parallel to each other to have an interval therebetween in the sliding direction of the movable contact point 7X.

In a side view, an outer periphery of the sliding portion 72 is formed in an arc shape, and the movable contact point 7X causes the outer periphery of the sliding portion 72 to make pressure contact with the fixed contact point 8 in the inhibiter switch 10.

Here, when the shift lever is operated, the movable contact point 7X is operated to slide on the fixed contact point 8 toward one of the sliding directions. Repetition of the sliding of the movable contact point 7X by the operation of the shift lever causes wear of the sliding portion 72 having made pressure contact with the fixed contact point 8, such that a thickness W1 of the sliding portion 72 becomes thin.

Then, support strength to the side wall portions 71 disposed to oppose across the sliding portion 72 is the weaker as the thickness W1 of the sliding portion 72 becomes thinner.

When the movable contact point 7X that slides on the fixed contact point 8 in association with the operation of the shift lever reaches a predetermined angular position in the circumferential direction around the axis line X, the movable contact point 7X gets over a step portion 9 formed in the pole board 2 to be spaced apart from the fixed contact point 8.

Therefore, the movable contact point 7X is subjected to stress in accordance with an operation force of the shift lever from abutment points P1 and P2 to the accommodation hole 53 that accommodates the movable contact point 7X therein at the time of sliding on the fixed contact point 8 or getting over the step portion 9 (refer to FIG. 5B).

Consequently, when the thickness W1 of the sliding portion 72 becomes thin to lower the support strength to the side wall portions 71, the side wall portions 71 cannot be held in a state of being disposed in parallel to each other against the acting stress, and are inclined in a direction of narrowing the interval of each other.

In addition, when the inclination of each of the side wall portions 71 in the direction of narrowing the interval of each other is large by the repetition of the sliding of the movable contact point 7X, the movable contact point 7X is largely deformed (refer to FIG. 5C), leading to the difficulty of causing the movable contact point 7X to be connected to/disconnected from the fixed contact point 8 in an appropriate position (angular position).

It is possible to extend a period (lifetime of the movable contact point 7X) for which the movable contact point 7X is connected to/disconnected from the fixed contact point 8 in an appropriate position by increasing the thickness W1 of the sliding portion 72.

However, since the movable contact point 7X is formed by bending one sheet of metallic plate, when the thickness (thickness of the metallic plate) of the sliding portion 72 is increased to meet a demand for recent long life, the thickness of the side wall portion 71 is also increased. Therefore, the movable contact point 7X is upsized.

Then, since a size of the movable contact pint 7X to the accommodation hole 53 of the contact point holding portion 52 is increased, the movable contact point 7X cannot be incorporated in the body case 4 of the inhibiter switch 10.

Therefore, there is a demand for preventing a deformation of the movable contact point without the upsizing thereof to extend the lifetime of the movable contact point.

SUMMARY OF THE INVENTION

Accordingly, the present invention is made in view of the above-described problems, and an object of the present invention is to provide a movable contact point for a switch which can prevent a deformation of the movable contact point without the upsizing thereof to extend the lifetime of the movable contact point.

According to an aspect of the present invention, a movable contact point for a switch in which a movable contact point that makes pressure contact with a fixed contact point is slid to cause the movable contact point and the fixed contact point be connected to/disconnected in accordance with a position of the movable contact point, comprises a pair of side wall portions that are disposed in parallel to each other to have an interval therebetween in the sliding direction of the movable contact point, a sliding portion that connects end portions of the pair of side wall portions in the fixed contact point-side to each other and slides on the fixed contact point, and projecting portions provided in respective opposing portions of the one side wall portion and the other wall portion in the pair of side wall portions to project in the sliding direction, wherein the projecting portions abut against each other between the pair of side wall portions in the sliding direction.

According to the aspect of the present invention, since the inclination of the pair of side wall portions in the direction of narrowing the interval of each other is blocked by the projecting portions abutting against each other between the pair of side wall portions, even if the thickness of the sliding portion becomes thin by wear to lower the support strength to the side wall portions, it is possible to prevent the movable contact point from being deformed due to the inclination of the pair of side wall portions in such a direction that the pair of side wall portions become narrow to each other.

Therefore, since it is not necessary to increase the thickness of the sliding portion, it is possible to prevent the deformation of the movable contact point without the upsizing thereof to extend the lifetime of the movable contact point.

BRIEF DESCRIPTION OF THE DRAWINGS

Other objects, features, and advantages of the present invention will become more apparent from the following detailed description made with reference to the accompanying drawings, in which like parts are designated by like reference numbers and in which:

FIGS. 1A to 1E are diagrams explaining a movable contact point according to an embodiment in the present invention, wherein FIG. 1A is a perspective view showing the movable contact point according to the embodiment, FIG. 1B is a side view showing the movable contact point according to the embodiment, FIG. 1C is a bottom view showing the movable contact point as viewed from a fixed contact point-side according to the embodiment, FIG. 1D is a front view showing the movable contact point according to the embodiment, and FIG. 1E is a cross section taken along line A-A in FIG. 1D;

FIGS. 2A to 2D are diagrams explaining a movable contact point according to a modification in the embodiment, wherein FIG. 2A is a perspective view showing the movable contact point according to the modification, FIG. 2B is a side view showing the movable contact point according to the modification, FIG. 2C is a front view showing the movable contact point according to the modification, and FIG. 2D is a side view showing the movable contact point in which a sliding portion becomes thin in thickness due to wear thereof according to the modification;

FIGS. 3A to 3C are diagrams explaining movable contact points according to modifications in the embodiment, wherein FIG. 3A is a perspective view showing a movable contact point according to a modification, FIG. 3B is a perspective view showing a movable contact point according to a different modification, and FIG. 3C is a perspective view showing a movable contact point according to a further different modification;

DESCRIPTION OF THE PREFERRED EMBODIMENT

Figure 1A:
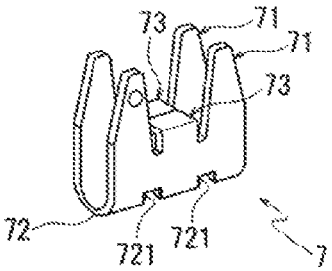
Figure 1C:
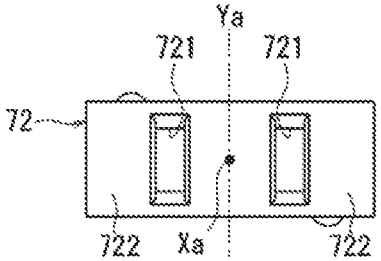
Figure 1E:
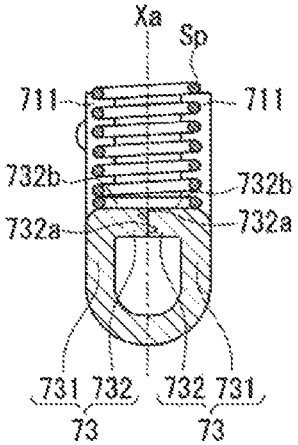
Figure 1B:
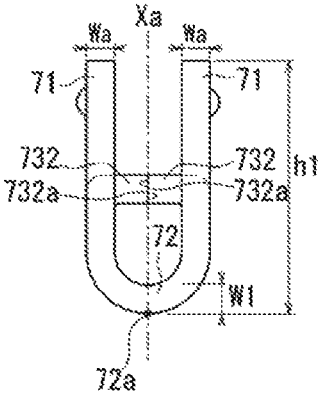

Hereinafter, a movable contact point for a switch according to an embodiment in the present invention will be explained with reference to the accompanying drawings, and FIGS. 1A to 1E are diagrams explaining a movable contact point 7 according to the embodiment. It should be noted that in the following explanation, for descriptive purposes, the upper side in FIG. 1B is indicated as an upward side and the lower side therein is indicated as a downward side.

As shown in FIGS. 1A and 1B, the movable contact point 7 has a basic configuration formed by bending one sheet of metallic plate in a U-letter shape, and a sliding portion 72 that slides on a fixed contact point 8 is positioned between a pair of side wall portions 71 disposed in parallel to each other to have an interval therebetween in the sliding direction (moving direction) of the movable contact point 7.

In a side view, the sliding portion 72 is provided to connect end portions of the side wall portions 71 in the fixed contact point 8-side to each other, and an outer shape of the sliding portion 72 is formed in an arc shape to put a central point (lower end 72*a*) of the movable contact point 7 in the sliding direction at the lowest position in the fixed contact point 8-side.

As shown in FIG. 1C, the sliding portion 72 has a substantially rectangular shape as viewed from the downward side of the fixed contact point 8-side, and two notch portions 721 are disposed on a lower surface of the sliding portion 72 in the fixed contact point 8-side to have an interval therebetween in the longitudinal direction (right-left direction in the figure) of the sliding portion 72.

The notch portions 721 are positioned to be symmetrical across a straight line Ya that passes through a center of the sliding portion 72 in the longitudinal direction (direction perpendicular to the sliding direction of the movable contact point 7) and extends in the width direction of the sliding portion 72 (sliding direction of the movable contact point 7), and the sliding portion 72 is provided with abutment portions 722 against the fixed contact point 8 at the opposite side to the notch portions 721 with reference to the straight line Ya.

As shown in FIG. 1B, each of the side wall portions 71 is provided in a direction perpendicular to the sliding portion 72, and has the same thickness Wa.

In a side view, each of the side wall portions 71 extends linearly in a direction of being away from the sliding portion 72 and a height h1 of each of the side wall portions 71 from the lower end 72*a* of the sliding portion 72 is equal.

Figure 1D:
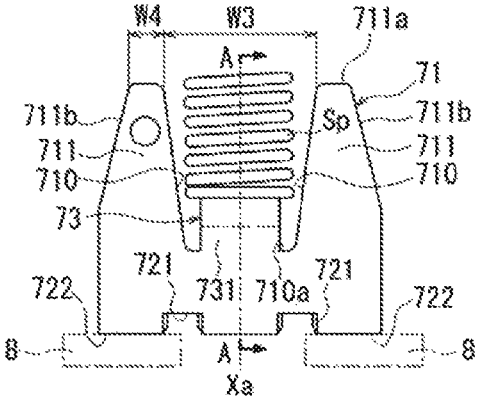

As shown in FIG. 1D, the side wall portions 71 of the movable contact point 7 are provided with a notch portion 710 formed in the central part therebetween in the longitudinal direction. The notch portion 710 extends downward to the sliding portion 72-side from upper ends 711*a* in the side wall portions 71 at the opposite side to the sliding portion 72, and a width W3 of the notch portion 710 is the narrower toward the downward side to the sliding portion 72-side.

Each of both side portions (regulation portions 711 to be described later) in the side wall portion 71 across the notch portion 710 is inclined in a direction where a side edge 711*b* of the regulation portion 711 at the opposite side to the notch portion 710 is closer to a center line (axis line Xa) passing through the center of the movable contact point 7 in the longitudinal direction from the halfway position in the longitudinal direction, and the regulation portion 711 has a width W4 in the longitudinal direction that is narrower toward the upper end 711*a*.

An abutment portion 73 to a spring Sp is provided on a lower part of the notch portion 710 in the sliding portion 72-side to project upward from a lower side 710*a* of the notch portion 710.

The abutment portion 73 is provided with base portions 731 extending upward from the central part of the lower side 710*a* in the notch portion 710 in the longitudinal direction, and an upper end side of the base portion 731 is bent in the sliding direction of the movable contact point 7 to form a projecting portion 732.

In the embodiment, the projecting portion 732 of the one side wall portion 71 and the projecting portion 732 of the other side wall portion 71 are disposed to oppose in the sliding direction of the movable contact point 7, and tip surfaces 732*a* thereof form flat surfaces in parallel to each other.

In the projecting portions 732 of the movable contact point 7, the tip surfaces 732*a* thereof abut against each other between the side wall portions 71 disposed to have an interval in the sliding direction of the movable contact point 7 (refer to FIG. 1E), and the rigidity strength of the movable contact point 7 in the sliding portion 72-side is enhanced by the projecting portions 732 abutting against each other.

In consequence, since the rigidity strength to the side wall portion 71 in the sliding portion 72-side is also enhanced, at the time the movable contact point 7 slides on the fixed contact point 8, even if the stress by the sliding acts on the abutment portions 722 to the fixed contact point 8, the side wall portions 71 are structured to be not easily inclined in a direction of being closer to each other by such stress.

Here, the movable contact point 7 slides in the right-left direction (one side and the other side in the sliding directions) in FIG. 1B. Therefore, even if the movable contact point 7 slides in any of the one side and the other side, for preventing the movable contact point 7 from being deformed by the stress acting by the sliding, the projecting portion 732 of the one side wall portion 71 and the projecting portion 732 of the other side wall portion 71 are disposed to cause the tip surfaces 732*a* to abut against each other on the axis line Xa that passes through the center of the movable contact point 7 in the sliding direction and is in parallel to a rotation center axis (axis line X) of the movable board 5.

Each of upper surfaces 732*b* of the projecting portions 732 is formed as an abutment surface of the spring Sp, and one end of the spring Sp in the longitudinal direction abuts against the abutment surfaces in the axis line Xa in parallel to the axis line X.

Figure 4:
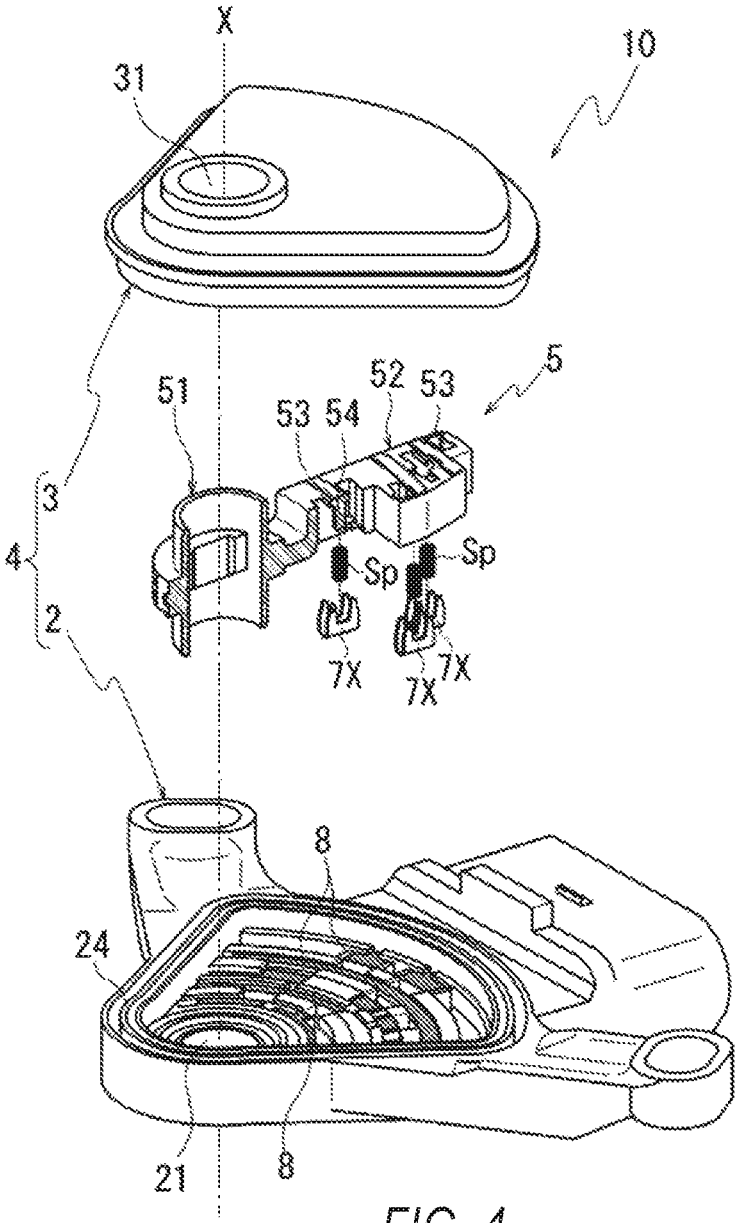
FIG. 4 (PRIOR ART)
FIG. 4 is diagrams explaining an inhibiter switch according to the conventional example.
Figure 5A:
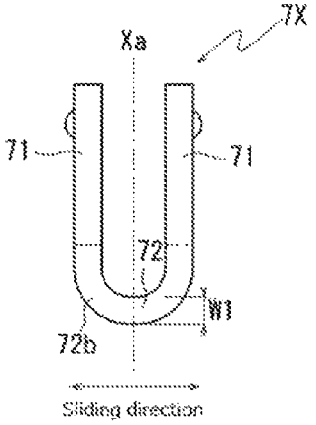
FIG. 5A (PRIOR ART)
FIGS. 5A to 5C are diagrams explaining a movable contact point according to the conventional example.
Figure 5B:
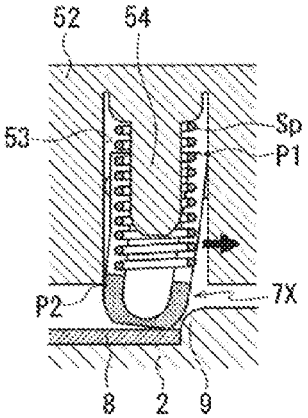
FIG. 5B (PRIOR ART)
Figure 5C:
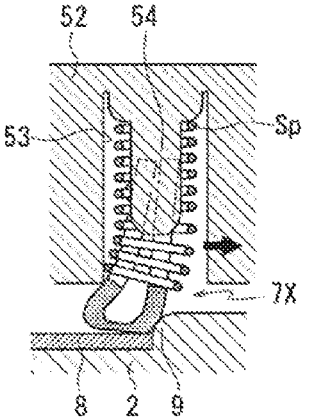
FIG. 5C (PRIOR ART)

In the embodiment, the other end of the spring Sp in the longitudinal direction is attached to be inserted around a cylindrical spring holding portion 54 (refer to FIG. 4) provided in the accommodation hole 53 of the contact point holding portion 52, and the movable contact point 7 against which one end of the spring Sp abuts is operated to be capable of advancing/retreating in the axial direction of the axis line Xa.

In addition, both sides in the side wall portion 71 across the notch portion 710 in the longitudinal direction form the regulation portions 711 that regulate the movement of the movable contact point 7 in the longitudinal direction (in the right-left direction in FIG. 1D). When the movable contact point 7 moves in the longitudinal direction, in a point where the spring Sp positioned in the notch portion 710 abuts against the regulation portions 711, the movement of the movable contact point 7 beyond that point is blocked.

According to the movable contact point 7 with this configuration, the projecting portions 732 abutting against each other enhance the rigidity strength of the movable contact point 7 in the sliding portion 72-side, and block the inclination of the side wall portions 71 in the direction of narrowing the interval therebetween.

Consequently, even if the thickness W1 of the sliding portion 72 is thin to lower the support strength to the side wall portions 71, the side wall portions 71 can be more stably held in a state of being disposed in parallel to each other than in a case of the conventional movable contact point 7X, which can appropriately prevent the movable contact point 7 from being largely deformed due to the inclination of the side wall portions 71 in a direction of approaching to each other. Therefore, it is possible to appropriately prevent the movable contact point 7 from being incapable of being connected to/disconnected from the fixed contact point 8 in an appropriate position.

As described above, in the movable contact portion 7 for the inhibiter switch structured such that the movable contact point 7 that makes pressure contact with the fixed contact point 8 is slid to cause the movable contact point 7 and the fixed contact point 8 to be connected to/disconnected in accordance with the position of the movable contact point 7, the movable contact point 7 comprises the pair of side wall portions 71 that are disposed in parallel to each other to have an interval therebetween in the sliding direction of the movable contact point 7, and the sliding portion 72 that connects end portions of the pair of side wall portions 71 in the fixed contact point 8-side to each other and slides on the fixed contact point 8.

The side wall portions 71 each have a predetermined width in a direction perpendicular to the sliding direction, and are provided with the notch portion 710 (notch) in the central part therebetween in the perpendicular direction, the notch portion 710 extending from the end portion at the opposite side to the sliding portion 72 to the vicinity of the sliding portion 72.

The projecting portions 732 projecting in the sliding direction are provided in the lower side 710*a*-side of the notch portion 710 in the sliding portion 72-side such that the projecting portions 732 abut against each other between the side wall portions 71 in the sliding direction.

With this configuration, the projecting portions 732 abutting against each other between the pair of side wall portions 71 enhance the rigidity strength of the movable contact point 7 in the sliding portion 72-side, and block the inclination of the pair of the side wall portions 71 in the direction of narrowing the interval therebetween.

Consequently, even if the thickness of the sliding portion 72 is thin by wear to lower the support strength to the side wall portions 71, it is possible to prevent the movable contact point 7 from being deformed due to the inclination of the side wall portions 71.

Therefore, it is possible to extend a period (lifetime of the movable contact point 7) for which the movable contact point 7 is connected to/disconnected from the fixed contact point 8 in an appropriate position without increasing the thickness of the sliding portion 72.

Further, when the movable contact point 7 is deformed, in some cases the deformed movable contact point 7 falls down from the accommodation hole 53 formed in the contact point holding portion 52, but occurrence of such an event can be properly prevented.

The upper end side of the base portion 731 extending upward from the central part of the lower side 710*a* in the notch portion 710 in the longitudinal direction is bent in the sliding direction of the movable contact point 7 to form the projecting portion 732, and the tip surfaces 732*a* of the projecting portions 732 form flat surfaces in parallel to each other. The projecting portions 732 are disposed to cause the tip surfaces 732*a* to abut against each other on the axis line Xa that passes through the center of the movable contact point 7 in the sliding direction and is in parallel to the rotation center axis of the movable board 5 (axis line X).

With this configuration, the projecting portions 732 abutting against each other enhance the rigidity strength of the movable contact point 7 in the sliding portion 72-side on which the stress acts at sliding. Therefore, even if the thickness of the sliding portion 72 is thin by wear to lower the support strength to the side wall portions 71, it is possible to appropriately prevent the movable contact point 7 from being deformed due to the inclination of the side wall portions 71 in a direction of approaching to each other.

Further, since the movable contact point 7 is formed of one sheet of metallic plate by press molding, the movable contact point can be manufactured less expensively than in a case of manufacturing the movable contact point by cutting a metallic, bar-shaped member, a cross section of which forms a shape of the movable contact point, by a predetermined width.

In addition, at the time of punching out the metallic plate, the base portion 731 and the projecting portion 732 can be formed using a material of a section of the notch portion 710 conventionally disposed of. In consequence, since a new material is not necessary for forming the abutment portion 73 provided with the base portion 731 and the projecting portion 732, it is possible to appropriately prevent the deformation of the movable contact point 7 without increasing the manufacturing cost.

Hereinafter, an explanation will be made of a movable contact point according to a modification in the embodiment.

FIGS. 2A to 2D are diagrams explaining a movable contact point 7A according to the modification.

It should be noted that in FIGS. 2A to 2D, components in common to those in the aforementioned movable contact point 7 are referred to as identical codes, and in the following explanation, a concrete explanation of the common components in the aforementioned movable contact point 7 will be omitted.

Figure 2A:
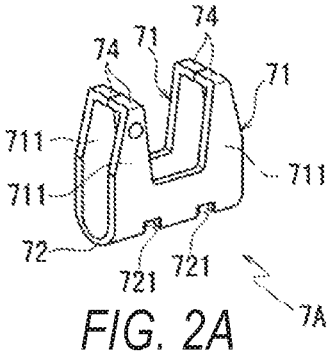
Figure 2C:
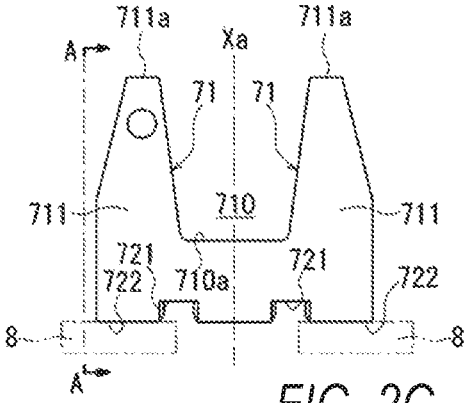
Figure 2B:
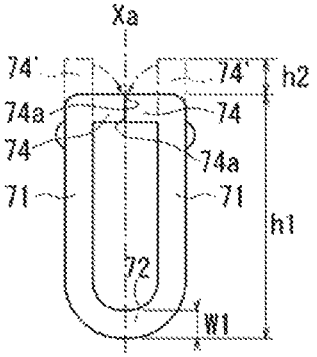
Figure 2D:
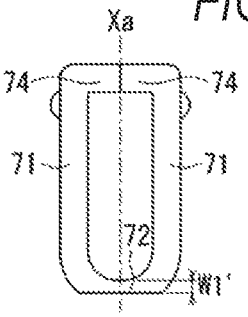

As shown in FIGS. 2A to 2C, the movable contact point 7A according to the modification is provided with projecting portions 74 in a regulation portion 711 positioned in one of the side wall portions 71 and a regulation portion 711 positioned in the other thereof across a notch portion 710.

The projecting portions 74 are provided to project in the sliding direction of the movable contact point 7A from upper ends 711*a* of the regulation portions 711, and the projecting portions 74 provided in the respective regulation portions 711 are structured such that tip surfaces 74*a* of the projecting portions 74 abut against each other between the regulation portions 711 opposing across a sliding portion 72.

Therefore, in the movable contact point 7A, the rigidity strength of the upper side in the side wall portion 71 (regulation portion 711) is enhanced by the projecting portions 74 abutting against each other to prevent the inclination of the upper sides of the side wall portions 71 opposing across the sliding portion 72 in the direction of approaching to each other.

Here, also in the movable contact point 7A according to the modification, even if the movable contact point 7A slides in any of the one side and the other side in the sliding direction, for preventing the movable contact point 7A from being deformed by the stress acting by the sliding, the projecting portion 74 of the one side wall portion 71 and the projecting portion 74 of the other side wall portion 71 are disposed to cause the tip surfaces 74*a* to abut against each other on the axis line Xa that passes through the center of the movable contact point 7A in the sliding direction and is in parallel to the rotation center axis of the movable board 5 (axis line X).

It should be noted that the movable contact point 7A according to the modification is also formed by bending one sheet of metallic plate. Therefore, at the time of manufacturing the movable contact point 7A, a length of the regulation portion 711 is made longer by a length h2 corresponding to the projecting portion 74 than the aforementioned movable contact point 7 in the metallic plate prior to being bent, and the lengthened section (refer to the numeral 74' in FIG. 2B) of the tip side of the regulation portion 711 is bent to form the projecting portion 74.

According to the movable contact point 7A with this configuration, the projecting portions 74 abutting against each other between the pair of side wall portions 71 enhance the rigidity strength of the movable contact point 7A at the opposite side to the sliding portion 72 (the upper end 711*a*-side of the regulation portion 711), and block the inclination of the side wall portions 71 (the regulations 711) in the direction of narrowing the interval therebetween to each other.

Consequently, even if the thickness W1 of the sliding portion 72 becomes thin to the extent of the thickness W1' to lower the support strength to the side wall portions 71, the side wall portions 71 can be held in a state of being disposed in parallel to each other to appropriately prevent the movable contact point 7A from being largely deformed due to the inclination of the side wall portions 71 (the regulation portions 711) in a direction of approaching to each other. Therefore, it is possible to appropriately prevent the movable contact point 7A from being incapable of being connected to/disconnected from the fixed contact point 8 in an appropriate position.

As described above, in the movable contact point 7A according to the modification, the side wall portions 71 each have a predetermined length in the direction perpendicular to the sliding direction, and are provided with the notch portion 710 (notch) that is in the central part therebetween in the perpendicular direction to extend from the upper end 711*a* at the opposite side to the sliding portion 72 to the vicinity of the sliding portion 72.

The projecting portions 74 are provided in one-side regulation portion 711 (side portion) and the other-side regulation portion 711 (side portion) of the side wall portions 71 in the longitudinal direction (perpendicular direction of the sliding direction) of the movable contact point 7A across the notch portion 710, and each of the projecting portions 74 is formed by bending the upper end side of the regulation portion 711 at the opposite side to the sliding portion 72 in the sliding direction of the movable contact point 7A.

When the notch portion 710 is disposed between the side wall portions 71, one-side regulation portion 711 and the other-side regulation portion 711 are likely to be easily deformed across the notch portion 710. Therefore, it is possible to suppress the deformation of the entire movable contact point 7A by providing the projecting portions 74 to the regulation portions 711 that are likely to be easily deformed.

Further, the projecting portions 74 that abut against each other block the regulation portions 711 opposing across the siding portion 72 from being inclined in the direction of narrowing the interval of each other. Therefore, even if the thickness of the sliding portion 72 is thin by wear to lower the support strength to the side wall portions 71, it is possible to appropriately prevent the movable contact point 7A from being deformed due to the inclination of the side wall portions 71 in the direction of approaching to each other.

Therefore, it is possible to extend a period (lifetime of the movable contact point 7A) for which the movable contact point 7A is connected to/disconnected from the fixed contact point 8 in an appropriate position without increasing the thickness of the sliding portion 72.

Figure 3A:
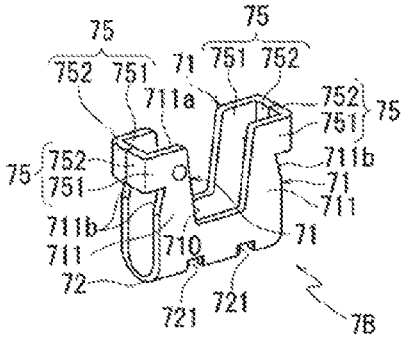
Figure 3B:
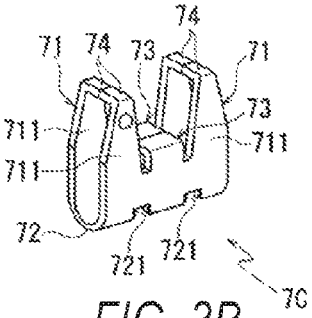
Figure 3C:
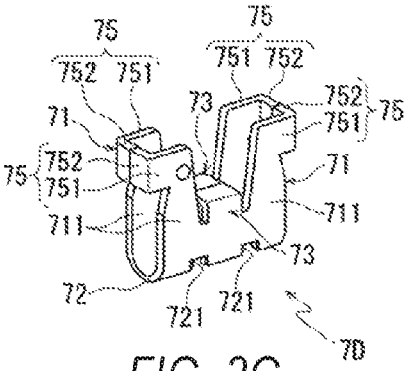

FIGS. 3A to 3C are diagrams explaining movable contact points according to modifications.

As shown in FIG. 3A, in a movable contact point 7B according to a modification, projecting portions 75 are provided in a regulation portion 711 positioned in one side and in a regulation portion 711 positioned in the other side in side wall portions 71 across a notch portion 710.

The projecting portion 75 is provided with a base portion 751 extending in the width direction of the regulation portion 711 (direction perpendicular to the sliding direction of the movable contact point 7B) from a side edge 711*b* of the regulation portion 711, and a tip side of the base portion 751 is bent in the sliding direction of the movable contact point 7B to form a projecting portion 752.

The projecting portions 752 in the movable contact points 7B are structured such that tip surfaces thereof abut against each other between the side wall portions 71 (regulation portions 711) disposed to have an interval therebetween in the sliding direction of the movable contact point 7B, and the rigidity strength of the upper side of the side wall portion 71 (regulation portion 711) in the movable contact point 7B is enhanced by the projecting portions 752 abutting against each other.

According to the movable contact point 7B with this configuration, the projecting portions 752 abutting against each other enhance the rigidity strength of the movable contact point 7B at the opposite side to the sliding portion 72, and block the inclination of the side wall portions 71 (the regulations 711) in the direction of narrowing the interval therebetween to each other.

Consequently, even if the thickness W1 of the sliding portion 72 becomes thin to lower the support strength to the side wall portions 71, the side wall portions 71 can be held in a state of being disposed in parallel to each other.

Thereby, it is possible to appropriately prevent the movable contact point 7B from being largely deformed with an increasing inclination of the side wall portions 71 (the regulation portions 711) in a direction of approaching to each other. Therefore, it is possible to appropriately prevent the movable contact point 7B from being incapable of being connected to/disconnected from the fixed contact point 8 in an appropriate position.

In the movable contact point 7B according to the modification, the side wall portions 71 each have a predetermined length in the direction perpendicular to the sliding direction, and are provided with the notch portion 710 (notch) that is in the central part therebetween in the perpendicular direction to extend from an upper end 711*a* at the opposite side to the sliding portion 72 to the vicinity of the sliding portion 72.

The projecting portions 752 are provided in one-side regulation portion 711 (side portion) and the other-side regulation portion 711 (side portion) of the side wall portions 71 across the notch portion 710 in the longitudinal direction (direction perpendicular to the sliding direction) of the movable contact point 7B.

Each of the projecting portions 752 is formed by folding back a tip side of the base portion 751 projecting in the longitudinal direction of the movable contact point 7B from a side edge 711*b* in the regulation portion 711 at the opposite side to the notch portion 710 in the sliding direction of the movable contact point 7B.

With this configuration also, the projecting portions 752 that abut against each other block the side wall portions 71 (regulation portions 711) opposing across the siding portion 72 from being inclined in the direction of narrowing the interval of each other. Therefore, even if the thickness of the sliding portion 72 is thin by wear to lower the support strength to the side wall portions 71, it is possible to appropriately prevent the movable contact point 7B from being deformed due to the inclination of the side wall portions 71 in the direction of approaching to each other.

Therefore, It is possible to extend a period (lifetime of the movable contact point 7B) for which the movable contact point 7B is connected to/disconnected from the fixed contact point 8 in an appropriate position without increasing the thickness of the sliding portion 72.

It should be noted that as shown in FIGS. 3B and 3C, there may be provided a movable contact point 7C or 7D configured by a combination of the projecting portion 732 provided in the abutment portion 73 in the movable contact point 7 as shown in FIGS. 1A to 1E and the projecting portions 74 and 75 in the movable contact points 7A and 7B as described above.

With this configuration also, even if the thickness of the sliding portion 72 is thin by wear to lower the support strength to the side wall portions 71, it is possible to appropriately prevent the movable contact point 7C or 7D from being deformed due to the inclination of the side wall portions 71 in the direction of approaching to each other.

Therefore, it is possible to extend a period (lifetime of the movable contact points 7C and 7D) for which the movable contact point 7C or 7D are connected to/disconnected from the fixed contact point 8 in an appropriate position without increasing the thickness of the sliding portion 72.

It should be noted that the embodiment exemplifies a case of the rotary switch in which the movable contact point 7 moves in the circumferential direction around the rotary shaft (axis line X), but the present invention may be applied suitably for a movable contact point of a sliding type switch in which movable contact points advance/retreat linearly.

While only the selected embodiment has been chosen to illustrate the present invention, it will be apparent to those skilled in the art from this disclosure that various changes and modifications can be made therein without departing from the scope of the invention as defined in the appended claims. Furthermore, the foregoing description of the embodiment according to the present invention is provided for illustration only, and not for the purpose of limiting the invention as defined by the appended claims and their equivalents.

2 Pole board
3 Cover
4 Body case
5 Movable board
7, 7A to 7D, 7X Movable contact point
8 Fixed contact point
9 Step portion
10 Inhibiter switch
24 Peripheral wall
51 Shaft portion
52 Contact point holding portion
53 Accommodation hole
54 Spring holding portion
71 Side wall portion
72 Sliding portion
72*a* Lower end
73 Abutment portion

74 projecting portion
74*a* Tip surface
75 Projecting portion
710 Notch portion
710*a* Lower side
711 Regulation portion
711*a* Upper end
711*b* Side edge
722 Abutment portion
731 Base portion
732 Projecting portion
732*a* Tip surface
732*b* Upper surface
751 Base portion
752 Projecting portion
P1, P2 Abutment point
Sp Spring
X Axis line
Xa Axis line
Ya Straight line

What is claimed is:

1. A movable contact point for a switch in which the movable contact point that makes pressure contact with a fixed contact point is slid to cause the movable contact point and the fixed contact point to be connected to/disconnected in accordance with a position of the movable contact point, comprising:

a pair of side wall portions that are disposed to have an interval therebetween in a sliding direction of the movable contact point;

a sliding portion that connects end portions of the pair of side wall portions in a fixed contact point-side to each other and slides on the fixed contact point; and projecting portions provided in respective opposing portions of the one side wall portion and the other wall portion in the pair of side wall portions to project in the sliding direction, wherein a rigidity strength portion of the movable contact point is formed by abutting the projecting portions against each other between the pair of side wall portions in the sliding direction.

2. The movable contact point for the switch according to claim 1, wherein:

the side wall portions each have a predetermined width in a direction perpendicular to the sliding direction and are provided with a notch portion at a central part in the perpendicular direction to extend from an end portion of the side wall portion at an opposite side to the sliding portion to a vicinity of the sliding portion, and the projecting portions are disposed to project in the sliding direction from a side edge in the notch portion in the sliding portion side.

3. The movable contact point for the switch according to claim 1, wherein:

the side wall portions each have a predetermined width in a direction perpendicular to the sliding direction and are provided with a notch portion at a central part in the perpendicular direction to extend from an end portion of the side wall portion at an opposite side to the sliding portion to a vicinity of the sliding portion, and the projecting portions are disposed in one side portion and in the other side portion of the side wall portions across the notch portion.

4. The movable contact point for the switch according to claim 3, wherein the projecting portions are provided in the one side portion and the other side portion to project in the sliding direction from one side edge in the perpendicular direction.

5. The movable contact point for the switch according to claim 3, wherein the projecting portions are provided in the one side portion and the other side portion to project in the sliding direction from the end portion at the opposite side to the sliding portion.

6. The movable contact point for the switch according to claim 1, wherein the movable contact point is formed by one sheet of metallic plate by press molding.

7. The movable contact point for the switch according to claim 1, wherein the movable contact point is symmetrical across a center axis between the pair of side wall portions.

8. The movable contact point for the switch according to claim 1, further comprising two notch portions disposed on a lower surface of the sliding portion, the notch portions having an interval therebetween in a longitudinal direction of the sliding portion.

* * * * *